US006789701B1

(12) United States Patent
Smith

(10) Patent No.: US 6,789,701 B1
(45) Date of Patent: Sep. 14, 2004

(54) TOOTHPASTE DISPENSER

(76) Inventor: John T. Smith, 356 Waterfront, Dixon, IL (US) 61021

( * ) Notice: Subject to any disclaimer, the term of this patent is extended or adjusted under 35 U.S.C. 154(b) by 0 days.

(21) Appl. No.: 10/287,006

(22) Filed: Nov. 4, 2002

(51) Int. Cl.[7] ..... B65D 35/28
(52) U.S. Cl. ..... 222/95; 222/105; 222/181.3; 222/382; 222/464.2
(58) Field of Search ..... 222/95, 105, 181.3, 222/382, 464.2

(56) References Cited

U.S. PATENT DOCUMENTS

| | | | | |
|---|---|---|---|---|
| 2,600,553 A | * | 6/1952 | Lord | 222/105 |
| 2,709,025 A | * | 5/1955 | Scott | 222/95 |
| 2,792,856 A | * | 5/1957 | Coppage | 222/380 |
| 4,322,020 A | * | 3/1982 | Stone | 222/95 |
| 4,570,829 A | | 2/1986 | Allen | |
| 5,271,529 A | | 12/1993 | Stuber | |
| 5,305,922 A | | 4/1994 | Varon | |
| 5,323,932 A | | 6/1994 | Bauman | |
| D359,188 S | | 6/1995 | Clements | |
| 5,452,825 A | * | 9/1995 | Comstock et al. | 222/181.2 |
| 5,487,877 A | | 1/1996 | Choi | |
| 5,499,742 A | | 3/1996 | Ives, Sr. | |
| 5,813,572 A | | 9/1998 | Kolacek | |
| 5,887,754 A | | 3/1999 | Wilkinson | |
| 5,897,029 A | | 4/1999 | Tong | |

FOREIGN PATENT DOCUMENTS

GB 2025515 A * 1/1980 ..... F04B/23/02

* cited by examiner

*Primary Examiner*—Kenneth Bomberg
(74) *Attorney, Agent, or Firm*—Keith Frantz

(57) ABSTRACT

A dispenser includes a base into which the open end of a conventional tube of toothpaste is threaded, a manually operated pump in the base to draw paste from the tube and discharge the paste onto a toothbrush, a perforated tube positioned in the tube of toothpaste to prevent prematurely collapsing of the walls and resulting flow restriction as paste is drawn from the tube, and a cover that hinges to the top of the base to conceal the tube and that provides presentation area for advertising, logos and other graphic or written information.

11 Claims, 4 Drawing Sheets

TOOTHPASTE DISPENSER

CROSS-REFERENCES TO RELATED APPLICATIONS

None.

REFERENCE TO MICROFICHE APPENDIX

N/A.

STATEMENT REGARDING FEDERALLY SPONSORED RESEARCH OR DEVELOPMENT

N/A.

BACKGROUND OF THE INVENTION

1. Field of Invention

The present invention relates to apparatus for dispensing paste from a tube of paste having on open threaded end, a closed end and collapsible walls therebetween.

More particularly, the invention relates to a manual dispenser which, while suitable for other uses, is particularly useful as a toothpaste dispenser that conceals the tube of toothpaste in an attractive casing, and that is mountable to a vertical structure such as a wall or mirror to reduce clutter in the surrounding area.

2. Description of Prior Art

Toothpaste is conventionally sold in a flexible tube having an open threaded neck-end with a cap, a closed folded end, and collapsible walls therebetween. The paste is dispensed by removing the cap and squeezing the tube to discharge toothpaste out the open end onto a toothbrush.

Of the various packaged forms of toothpaste currently available, the conventional tube of toothpaste is the most economical. Unfortunately, this cost advantage is associated with at least the following drawbacks and disadvantages related to use of conventional tubes of toothpaste:

If the cap is not promptly replaced after dispensing toothpaste, as seems to be the case with at least one person in almost every household, there is the possibility of losing the cap; exposure of the toothpaste to contamination; the paste crusting over at the open end, and drying out throughout the tube if the tube is not used relatively quickly; and the paste being inadvertently discharged from the tube as it is subsequently handled, or between uses while stored such as on a shelf, in a drawer, or on countertop.

If the tube is squeezed in the center to dispense toothpaste, as is often the case with the same person that does not promptly replace the cap, a portion of the paste is forced to the closed end of the tube. This results in a restriction in the center of the deformed tube and makes it more difficult to subsequently dispense paste from the back portion of the tube as the paste in the front of the tube is exhausted.

There is often a question of what to do with the tube of toothpaste between uses. Tubes of toothpaste in an unattractive condition can often be seen lying around a sink area. And even if properly closed and cleaned after each use, the tubes tend to become unsightly over time.

Numerous devices have been proposed to address these and other drawbacks associated with use of conventional tubes of toothpaste. In particular, as concerns the present invention, there are several known devices to hold a tube of toothpaste and manually dispense the paste upon demand by the user.

For reasons mentioned above, it is desirable that the toothpaste tube collapse beginning at the folded end and progressing toward the open end while dispensing the toothpaste—to insure relative ease in dispensing toothpaste from the tube.

Accordingly, several manual dispensing devices use an arrangement to simulate ideal manual squeezing of the tube from the folded closed end and progressing toward the open end upon subsequent uses. Examples of such devises are shown in U.S. Pat. No. 5,271,529 (Stuber); U.S. Pat. No. 5,323,932 (Bauman); U.S. Pat. No. 5,499,742 (Ives, SR.); Des. U.S. Pat. No. 359,188 (Clements); and U.S. Pat. No. 5,813,572 (Kolacek).

Certain other devices use a pump to draw toothpaste from the tube and dispense the paste onto a toothbrush.

Such devices are shown is U.S. Pat. No. 4,570,829 (Allen); and U.S. Pat. No. 5,305,922 Varon).

However, drawing toothpaste from a tube with suction from a pump at the open end can result in the walls of the tube being drawn toward one another, and collapsing prematurely near the center of the tube. This result is similar to the user squeezing the tube in the center—both of which result in a restriction near the center of the tube that inhibits flow of paste from the closed end of the tube during subsequent uses.

Consequently, there is a need for a manual toothpaste dispenser that addresses such drawbacks and disadvantages, and permits purchase and use of conventional tubes of toothpaste without the inconveniences normally associated therewith.

SUMMARY OF THE INVENTION

The general aim of the present invention is to provide a new and improved device for holding a tube of toothpaste and manually dispensing the paste therefrom.

Important objectives of the invention include providing:

- a toothpaste dispenser that dispenses paste quickly, cleanly, and more easily than conventional dispensing methods and apparatus;
- a toothpaste dispenser that protects the contents of the tube from contamination and exposure to the elements;
- a toothpaste dispenser that reduces wasted paste resulting from contamination or loss of the cap;
- a toothpaste dispenser that can be mounted to a vertical structure, such as a wall or a mirror, to assist in reducing clutter of the tube lying around, and assist in organizing the sink or personal hygiene area; and
- a toothpaste dispenser that prevents the walls of the tube from prematurely collapsing as paste is drawn from the tube, to insure an even flow of toothpaste during repeated uses.

These and other objectives and advantages of the invention will become more apparent from the following detailed description when taken in conjunction with the accompanying drawings wherein like numerals refer to like items.

A preferred toothpaste dispenser according to the invention includes:

- a base into which the open end of the tube of toothpaste is threaded,
- a pump located in the base to draw paste from the open end of the tube and to dispense paste from a discharge tube on the opposite side of the base,
- a push button or lever to manually actuate the pump and dispense the toothpaste,
- a perforated tubular structure that slips into the tube of toothpaste prior to threading onto the base, the tubular structure keeping the walls of the tube of toothpaste from prematurely collapsing as paste is drawn therefrom, and a cover that hinges at the top of the base to cover and conceal the tube in an attractive presentation, the cover being provided with an area onto which advertising, logos or information may be etched or carried on a label.

Figure 1:
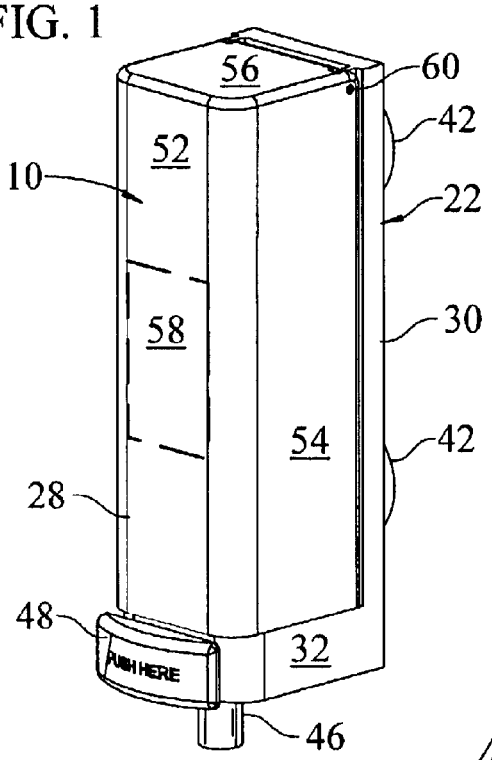
FIG. 1 is a front perspective view of a new and improved toothpaste dispenser incorporating the unique aspects of the present invention.
Figure 2:
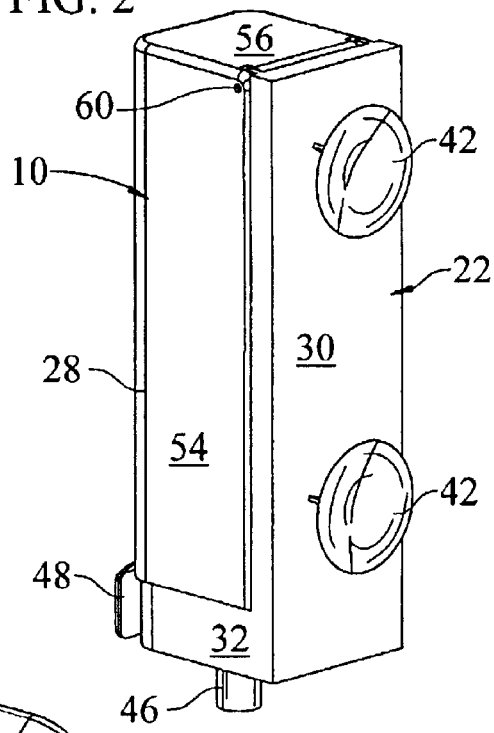
FIG. 2 is a back perspective view of the dispenser.
Figure 3:
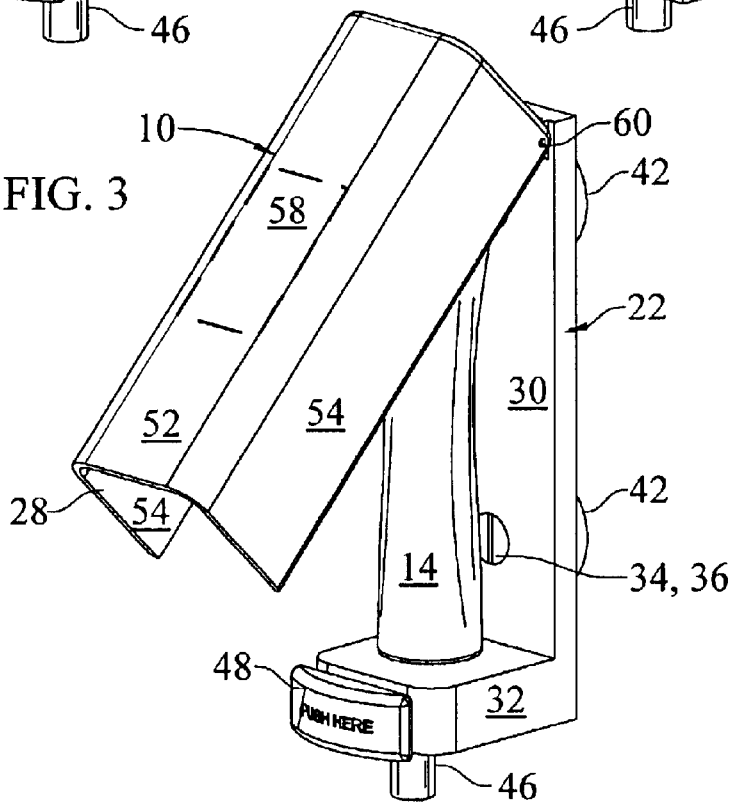
FIG. 3 is a front perspective view showing the cover in a partially open position.

While the invention is susceptible of various modifications and alternative constructions, certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

Reference numerals shown in the drawings correspond to following:

10—Toothpaste dispenser
12—Toothpaste
14—Tube of toothpaste
14*a*—Threaded outlet of tube
14*b*—Folded end of tube
14*c*—Walls of tube
16—Toothbrush
18—Vertical Wall
22—Base structure
24—Pump
26—Perforated tube
26*a*—Tapered upper end of perforated tube
26*b*—Lower end of perforated tube
28—Cover
30—Back wall
32—Base
34—Mounting holes
36—Fasteners
42—Suction cups
44—Threaded inlet to pump
46—Discharge tube
48—Push button
50—Openings in perforated tube
52—Front wall
54—Side walls
56—Top wall
58—Label
60—Hinges
62—Hinge plates
64—Hinge pins
66—Hinge journals

DETAILED DESCRIPTION OF THE INVENTION

Figure 4:
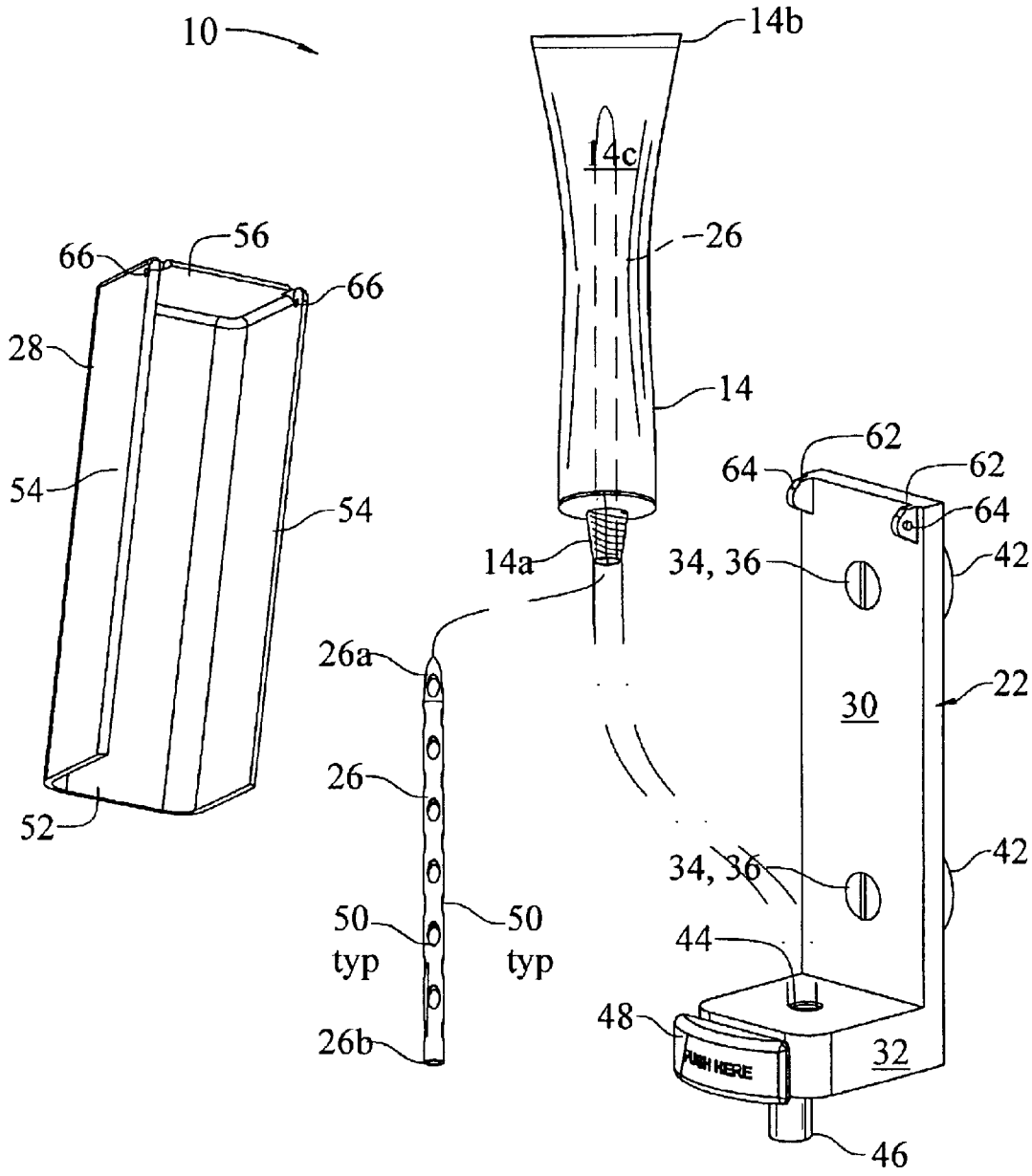
FIG. 4 is an exploded perspective view of certain components of the dispenser.
Figure 8:
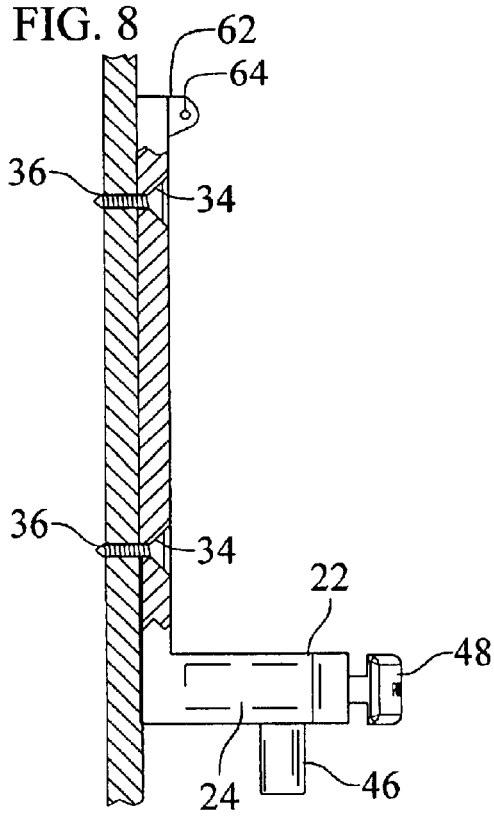
FIG. 8 is a fragmentary cross-sectional view showing an alternate mounting of the dispenser.
Figure 5:
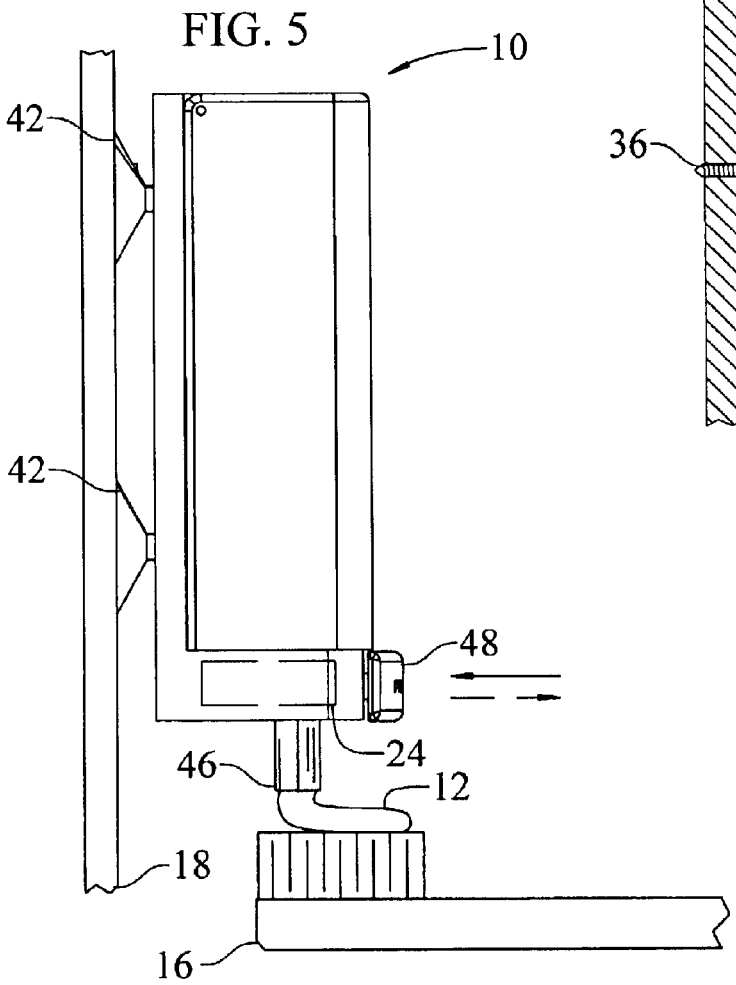
FIG. 5 is a side elevation view showing the dispenser mounted to a wall and dispensing paste onto a toothbrush.
Figure 6:
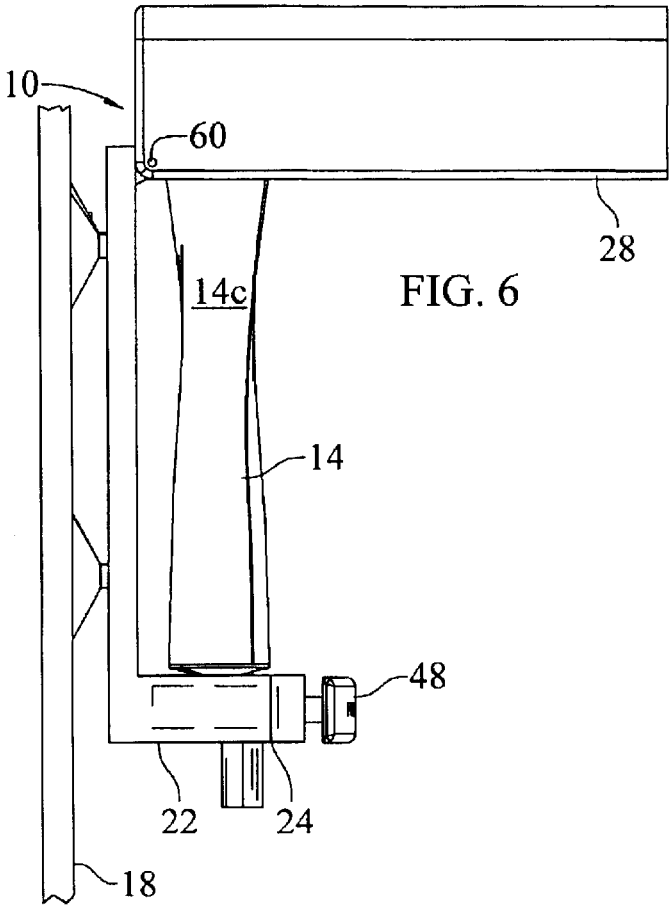
FIG. 6 is a side elevation view of the dispenser shown with the cover fully open.
Figure 7:
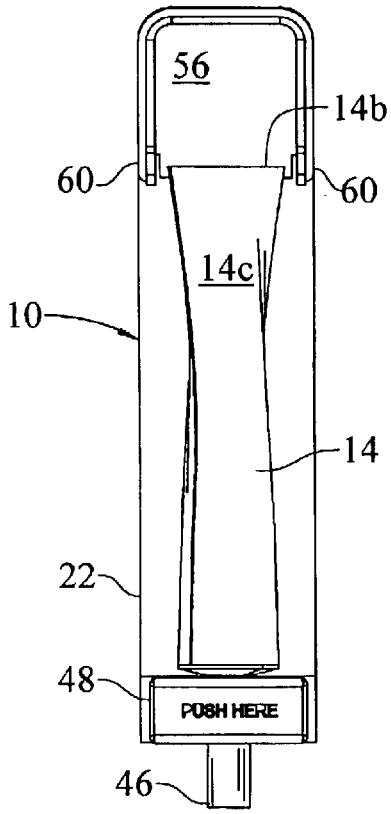
FIG. 7 is a front view of the dispenser shown with the cover fully open.
Figure 9:
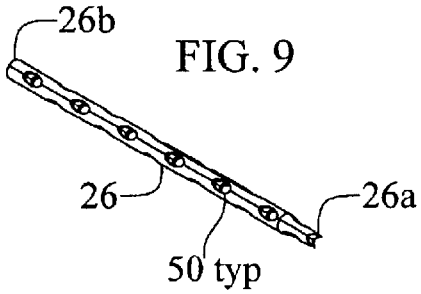
FIG. 9 is perspective view rotated 90 degrees of the hollow support tube shown in FIG. 4.

The present invention is shown in the drawings as toothpaste dispenser 10 (FIG. 1) that dispenses toothpaste 12 from a tube 14 of toothpaste onto a toothbrush 16 (see FIG. 5). The dispenser 10 is shown in several views and operative positions in FIGS. 1–3 and FIGS. 5–7, and additional details of certain dispenser components are shown in FIGS. 4 and 8–9.

The dispenser 10 includes a base structure 22 and a cover 28. The base structure 22 is provided with a back wall 30, and an integral base 32. The back wall 30 is a generally planar (see e.g., FIG. 4), somewhat elongated unit, having a width and length sized for correspondence with the maximum width and length of tube 14 of toothpaste to be held in the dispenser 10. Mounting holes 34 are formed through the back wall 30 proximate the top and bottom ends thereof to enable mounting the dispenser such as to a vertical wall member 18. Suitable mounting mechanisms include, but are not limited to, suction cups 42 (see e.g., FIG. 5) for mounting to a smooth surface such as a mirror or glazed ceramic tile, and threaded fasteners 36 (FIG. 8) for permanent mounting of the dispenser. The base 32 projects forwardly from the lower end of the back wall 30.

A threaded opening 44 is formed downwardly from the top surface of the base 32. The opening 44 is sized for threading the open-end neck 14*a* of the toothpaste tube 14 of toothpaste. A discharge tube 46 projects downwardly from the bottom of the base 32.

A manually operable pump mechanism 24, represented by dashed lines, is located in a cavity in the base 32 of the dispenser. The pump establishes fluid communication between the threaded opening 44 in the base and the discharge tube 46, and is operative to draw paste from the tube 14 through the threaded end 14*a* installed into the opening 44, and to dispense the paste out the discharge tube. The pump is activated by a push button 48 that extends forwardly from the front of the base 32. Pressing the push button towards the base effects operation of the pump to dispense a quantity of toothpaste. Thereafter, a return spring of the pump mechanism resets the push button in anticipation of the next dispensing cycle. Instructional indicia such as "PUSH HERE" is provided on the push button for straightforward, self-evident operation. The details of the pump mechanism are not a subject of the present invention, and are therefore, not shown or discussed in detail. Any of several known pumps, as well as certain pumps likely to be devised, may be provided in the dispenser.

A perforated tubular structure, inserted into the tube 14 of toothpaste prior to installation of the tube on the base 32 of the dispenser, prevents the walls 14*c* of the tube of toothpaste from prematurely collapsing completely onto one another as paste is drawn from the tube. The perforated tubular structure in the embodiment shown is provided in the form of a cylindrical perforated hollow tube 26 open ends 26*a*, 26*b*. The perforated tube is sized to slip into the tube 14 of paste, through the opening 14*a*, and to extend therefrom to proximate the folded end 14*b* of the tube. The perforated tubular structure is characterized with multiple lateral openings 50 that are angularly and longitudinally spaced through the tube walls along the length thereof to establish multiple flow paths into the interior of the tube and out the lower end 26*b* of the tube. The preferred tube has a relatively thin wall, and size of the openings 50 are of the same order of magnitude as the size of the opening 14*a* in the tube so as to not restrict the flow of toothpaste substantially more than the restriction established by the tube itself. In preferred embodiments, the outside diameter of the upper end 26*a* of the perforated tube 26 is tapered inwardly upon progressing toward the free end thereof, or rounded or otherwise configured to provide an initial lead-in clearance with the inlet opening 14*a*, for ease of aligning and inserting that end of the perforated tube into and through the opening 14*a* in the tube 14 of toothpaste.

The cover 28 includes a front wall 52, a pair of sidewalls 54, and a top wall 56. The front wall 52 extends generally parallel to the back wall 30, along the length thereof, and includes a generally planar or otherwise configured front surface to carry advertising or other information, either formed (e.g., molded or etched) in the front surface or on a label 58 affixed thereto. The sidewalls 54 extend integrally from the sides of the front wall 52 rearwardly to the back wall 30, and along the length thereof, to define, in cooperation with the base 32, a generally surrounded compartment to enclose the tube 14 of toothpaste. The top wall 56 extends integrally between the front wall 52 and the sidewalls 54, to the back wall, to close off the top of the cover.

A hinge mechanism 60 is provided between the cover 28 and the back wall 30 at the upper ends thereof for pivotal connection of the cover to the base structure 22, and swinging of the cover between a closed position (see FIGS. 1–2) and an open position (FIGS. 7–8) sufficient for installation and removal of the tube of paste. The hinge 60 shown is established with (a) a pair integral laterally spaced hinge plates 62 projecting forwardly from the upper end of the back wall 30, (b) a pair of integral hinge pins 64 projecting laterally outwardly from the hinge plates 62, and (c) a pair of hinge journals 66 formed in the upper end of the sidewalls 54, extending outwardly from the inside surfaces thereof and pivotally receiving the hinge pins 64. The hinge components are sized for snapping the cover onto and off the base structure. A latch mechanism is also provided to normally maintain the cover in the closed position. In this instance, the hinge pins 64 and journals 66 are sized for a snug or friction fit; or, for example, a detent mechanism may be provided in the hinge mechanism 60, or the cover sized for a snug fit onto the upper portion of the base 32.

Use of the dispenser 10 is a straightforward procedure. Prior to use, the dispenser is mounted to a stable structure such as a wall or mirror. The tube 14 of toothpaste is prepared for installation into the dispenser by removing the lid from the tube, and then inserting the perforated tube 26 through the threaded end 14*a* into the tube of toothpaste. The dispenser cover 28 is raised, and the end 14*a* of the prepared tube of toothpaste is threaded into opening 44 until snugly in position on base 32 of the dispenser. The cover is then closed, and the dispenser is ready for use. When a quantity of toothpaste is desired, the user positions the head of the toothbrush 16 under the free end of the discharge outlet tube 46, and then presses the push button 48 toward the base 32, causing the pump to draw a measured quantity of paste from the tube 14 and dispense the paste out the discharge tube and onto the toothbrush. The reset spring of the pump mechanism then returns the push button outwardly to its normal reset position, ready for use by the next person. When the tube 14 of paste is empty, the empty tube is removed and replaced with a new one into which a perforated tube 26 has been installed. The perforated tube from the used tube of paste is either disposed of along with the used tube, or is removed and reused in the new tube of toothpaste.

From the foregoing, it will be apparent that the present invention brings to the art a new and improved dispenser that cleanly dispenses a quantity of toothpaste from a conventional tube of toothpaste, and eliminates annoyances normally associated with tubes of toothpaste. Among other things, the dispenser fully encloses the tube of paste, the cover supports presentation of advertising or other information, the push button provides a simple, straightforward operation, and the perforated tube promotes efficient dispensing of the toothpaste by preventing the walls of the tube from collapsing onto each other as paste is drawn from the tube of toothpaste.

I claim:

1. A paste dispenser for dispensing paste from a replaceable tube of paste having an open threaded neck, a closed end opposite the threaded neck, and collapsible tubular walls therebetween, the dispenser comprising:

a) a vertical back wall having a front side and a back side and having upper and lower portions;

b) a base extending forwardly from the lower portion of the back wall in fixed relation thereto;

c) the base being provided with (1) a downwardly extending threaded inlet opening sized for receiving the threaded neck of the tube and supporting the tube in an inverted position, and (2) a discharge opening;

d) a manually operated pump located in the base, (1) the pump establishing fluid communication between the inlet and discharge openings in the base, the pump being operative to draw paste from the tube when threaded into the inlet opening and to discharge paste from the tube therein through the discharge opening;

e) a cover having (1) a front wall spaced forwardly of the back wall and having side edges, (2) a pair of integral side walls extending from the side edges of the front wall to proximate the back wall so as to establish a generally surrounded compartment for the tube when threaded into the base, and (3) an integral top wall extending between the front wall and the side walls to close the top of the compartment;

f) the cover being releasably connected in relation to the back wall for opening and closing the compartment; and g) a perforated tubular structure removably insertable through the open threaded neck of the tube, the perforated tubular structure having a width corresponding proximately to the diameter of the open threaded neck of the tube and having length corresponding proximately to at least one-half the length of the tube.

2. The paste dispenser as defined in claim 1 in which the cover is hinged to the back wall.

3. The paste dispenser as defined in claim 1 in which the perforated tubular structure is provided in the form including a hollow tube having angularly and longitudinally spaced openings formed lateral through the walls of the hollow tube.

4. The paste dispenser as defined in claim 3 in which the hollow tube include an upper portion that tapers inwardly upon progressing toward the free end thereof, and a lower portion having a diameter sized for a snug fit with the threaded open neck of the tube of paste.

5. The paste dispenser as defined in claim 4 in which the hollow tube is generally cylindrical along its axial length.

6. The paste dispenser as defined in claim 1 further comprising a mounting structure connected to the back wall for mounting the dispenser to a vertical support structure.

7. The paste dispenser as defined in claim 6 in which the mounting structure includes at least one of (i) openings extending through the back proximate the upper and lower portions thereon and (ii) suction cups connected proximate the upper and lower portions of the back wall and facing rearwardly therefrom.

8. The paste dispenser as defined in claim 1 further comprising a push button operatively connected to the pump and positioned for movement forwardly and rearwardly from the base to effect operation of the pump.

9. A paste dispenser for dispensing paste from a replaceable tube of paste having an open threaded neck, a closed end opposite the threaded neck, and collapsible tubular walls therebetween, the dispenser comprising:

a) a vertical back wall having a front side and a back side and having upper and lower portions;

b) a mounting structure connected to the back wall for mounting the dispenser to a vertical support structure;

c) a base extending forwardly from the lower portion of the back wall in fixed relation thereto;

d) the base being provided with (1) a downwardly extending threaded inlet opening sized for receiving the threaded neck of the tube and supporting the tube in an inverted position, and (2) a discharge opening;

e) a manually operated pump located in the base, (1) the pump establishing fluid communication between the inlet and discharge openings in the base, the pump being operative to draw paste from the tube when threaded into the inlet opening and to discharge paste from the tube therein through the discharge opening;

f) a cover having (1) a front wall spaced forwardly of the back wall and having side edges, (2) a pair of integral side walls extending from the side edges of the front wall to proximate the back wall so as to establish a generally surrounded compartment for the tube when threaded into the base, and (3) an integral top wall extending between the front wall and the side walls to close the top of the compartment;

g) the cover being hinged to the back wall for opening and closing the compartment; and h) a perforated, generally cylindrical removably insertable through the open threaded neck of the tube, the perforated tube having an outside diameter corresponding proximately to the diameter of the open threaded neck of the tube and having length corresponding proximately to at least one-half the length of the tube.

10. The paste dispenser as defined in claim 9 in which the perforated tube include an upper portion that tapers inwardly upon progressing toward the free end thereof, and a lower portion having a diameter sized for a snug fit with the threaded open neck of the tube of paste.

11. The paste dispenser as defined in claim 9 in which the mounting structure includes at least one of (i) openings extending through the back proximate the upper and lower portions thereon and (ii) suction cups connected proximate the upper and lower portions of the back wall and facing rearwardly therefrom.

* * * * *